US006678481B2

(12) United States Patent
Sawanaka et al.

(10) Patent No.: US 6,678,481 B2
(45) Date of Patent: Jan. 13, 2004

(54) IMAGE FORMING APPARATUS WITH OPENABLE-AND-CLOSABLE MEMBER POSITIONABLE SWITCH FEATURE

(75) Inventors: Kei Sawanaka, Shizuoka (JP); Tomio Noguchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/058,410

(22) Filed: Jan. 30, 2002

(65) Prior Publication Data

US 2002/0114633 A1 Aug. 22, 2002

(30) Foreign Application Priority Data

Feb. 7, 2001 (JP) ..... 2001-030817

(51) Int. Cl.[7] ..... G03G 15/00; G03G 21/00
(52) U.S. Cl. ..... 399/9; 399/13
(58) Field of Search ..... 399/9, 13, 411

(56) References Cited

U.S. PATENT DOCUMENTS 4,260,904 A * 4/1981 Horie et al. ..... 399/21 X
6,125,251 A * 9/2000 Shiraishi et al. ..... 399/124

FOREIGN PATENT DOCUMENTS

| | | | |
|---|---|---|---|
| JP | 2-99975 | * | 4/1990 |
| JP | 7-92879 | * | 4/1995 |
| JP | 8-152756 | * | 6/1996 |
| JP | 8-285183 | * | 11/1996 |
| JP | 2000-207970 | * | 7/2000 |
| JP | 2001-125331 | * | 5/2001 |
| JP | 2001-152726 | * | 6/2001 |

* cited by examiner

*Primary Examiner*—Fred L. Braun
(74) *Attorney, Agent, or Firm*—Fitzpatrick, Cella, Harper & Scinto

(57) ABSTRACT

An image forming apparatus includes an openable and closable member openable and closable relative to the main body of the apparatus. A switch, which is held by a holding member, detects, the opened and closed states of the openable and closable member. The holding member is movable relative to the main body of the apparatus. The openable-and-closable member has an engagement portion to be engaged with the switch, and the engagement portion positions the holding member.

8 Claims, 9 Drawing Sheets

IMAGE FORMING APPARATUS WITH OPENABLE-AND-CLOSABLE MEMBER POSITIONABLE SWITCH FEATURE

BACKGROUND OF THE INVENTION

1. Field of the Invention

The invention relates to an image forming apparatus such as a copier, a laser beam printer or a facsimile apparatus, and particularly to an image forming apparatus in which the opening and closing of an openable and closable member are detected.

2. Description of Related Art

An openable and closable cover and an opening and closing detecting mechanism according to the conventional art will hereinafter be described in detail with reference to FIG. 7 of the accompanying drawings. FIG. 7 is a schematic view of the openable and closable cover mechanism of a laser beam printer according to the conventional art.

In FIG. 7, the reference numeral 101 designates the main body of the apparatus, and the reference numeral 102 denotes an openable and closable cover. The openable and closable cover 102 is assembled to the main body 101 of the apparatus for rocking movement with a rocking movement support shaft 107 as a fulcrum. A restraining member 108 for restraining the openable and closable cover 102 on the main body 101 of the apparatus is assembled to the openable and closable cover 102 for rocking movement with a rocking movement support shaft 109 as a fulcrum. The reference numeral 106 designates a switch for detecting the opening and closing of the openable and closable cover 102, and the reference numeral 105 denotes a holder for holding the switch 106. The holder 105 is fixed to the main body 101 of the apparatus by a positioning boss 101*c* provided in the main body 101 of the apparatus. The openable and closable cover 102 is turned from its opened state to its closed state about the rocking movement support shaft 107, whereby the restraining member 108 is rocked with the rocking movement support shaft 109 as a fulcrum and a hook portion 108*a* is hooked on a lock portion 101*b*, whereby the openable and closable cover 102 is restrained in its closed state on the main body 101 of the apparatus. A pressure member 104 assembled to the openable and closable cover 102 pressed the switch 106, which thus detects the closed state of the openable and closable cover 102.

Also, when the grip portion 108*b* of the restraining member 108 is raised, the restraining member 108 rocks about the rocking movement support shaft 109 and the hook portion 108*a* is disengaged from the lock portion 101*b* to thereby release the restraint of the openable and closable cover 102. When the released openable and closable cover 102 is turned to its opened state, the pressure member 104 releases its pressure against the switch 106 to thereby detect the opened state of the openable and closable cover 102.

However, the above-described conventional art has suffered from a problem as will be described below.

In recent years, the structure of the laser beam printer has become complicated, and numerous parts are interposed between the switch 106 and the pressure member 104 as will be seen from the assembling tolerance of the holder 105 to the main body 101 of the apparatus, the assembling tolerance of the openable and closable cover 102 to the main body 101 of the apparatus, the assembling tolerance of a positioning member (such as the positioning boss 101*c*) and the pressure member 104 to the openable and closable cover 102, and so on, and the tolerances of the respective parts affect the accuracy of the positional relationship between the switch 106 and the pressure member 104.

That is, in the main body 101 of the image forming apparatus, it is difficult to improve the accuracy of the positional relationship between the switch 106 for detecting the opened and closed states of the openable and closable cover 102 and the pressure member 104 for pressing the switch 106 provided in the main body 101 of the apparatus.

Therefore, there is the possibility of causing a malfunction due to an erroneous detection that in spite of the openable and closable cover 102 having been closed, the switch is not pressed but the opened state is detected and the printer does not operate or although the openable and closable cover 102 is not properly closed, the closed state thereof is detected and the printer operates. Particularly, in the case where the openable and closable cover 102 serves also as a part of a conveying route for a sheet, although an openable and closable guide is not in its regular closed state, its closed state is detected to thereby cause a jamming of the sheet.

SUMMARY OF THE INVENTION

It is a first object of the present invention to provide an image forming apparatus in which the opened and closed states of an openable and closable member are reliably detected.

It is a second object of the present invention to provide an image forming apparatus having an openable and closable member openable and closable relative to the main body of the apparatus, and detecting means for detecting the opened and closed states of the openable and closable member, the openable and closable member having an engagement portion engaged with the detecting means, one of the detecting means and the engagement portion of the openable and closable member being movable relative to the other.

It is a third object of the present invention to provide an image forming apparatus having a first openable and closable member openable and closable relative to the main body of the apparatus, a second openable and closable member openable and closable relative to the main body of the apparatus, and detecting means for detecting the opened and closed states of the first openable and closable member and the second openable and closable member, wherein the detecting means detects the closed state only when both of the first openable and closable member and the second openable and closable member have been closed.

Further objects of the present invention will become apparent from the following description

DETAILED DESCRIPTION OF THE PREFERRED EMBODIMENTS

Some preferred embodiments of the present invention will hereinafter be described in detail with reference to the drawings. However, the dimensions, materials, shapes and relative arrangements of constituent parts described in these embodiments should be suitably changed depending on the construction and various conditions of an apparatus to which the present invention is applied, and the scope of the invention is not intended to be restricted to the following embodiment.

First Embodiment

Figure 6:
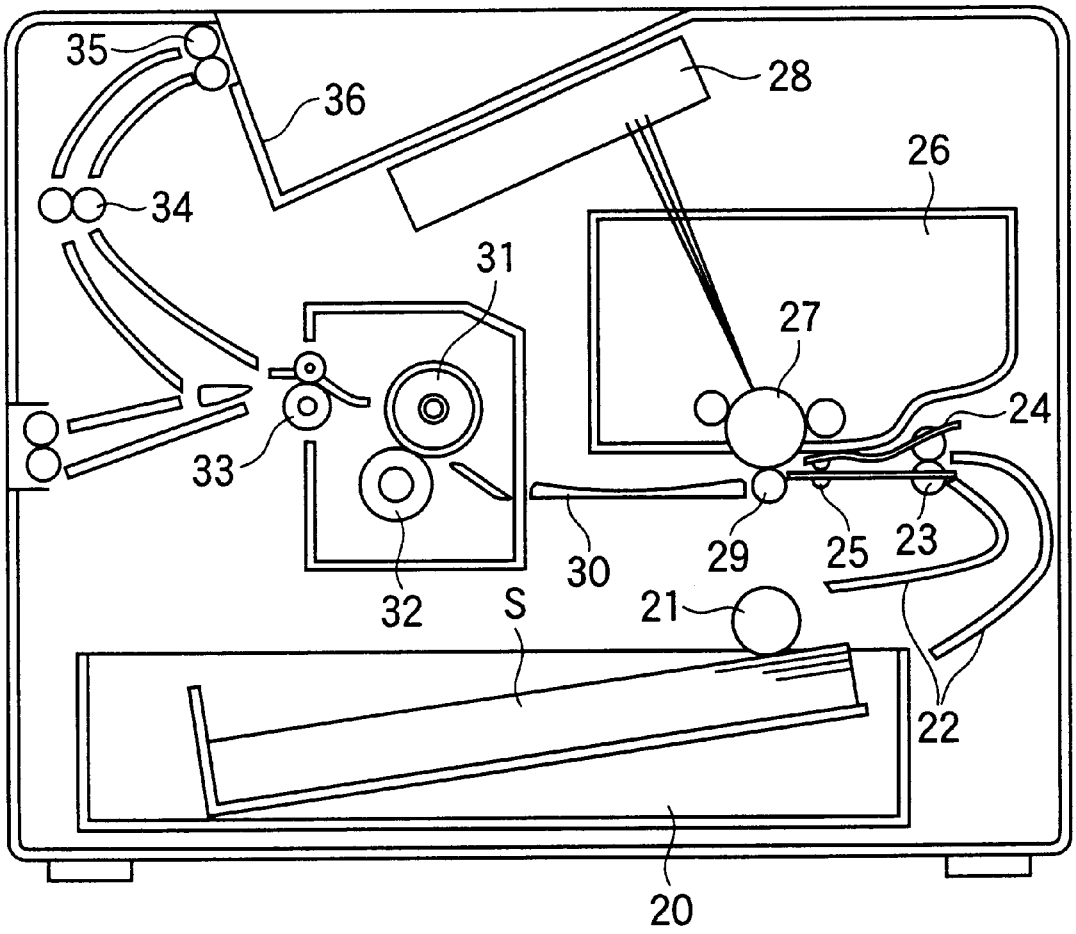
FIG. 6 shows the structure of a laser beam printer as an image forming apparatus to which the present invention is applicable.
Figure 7:
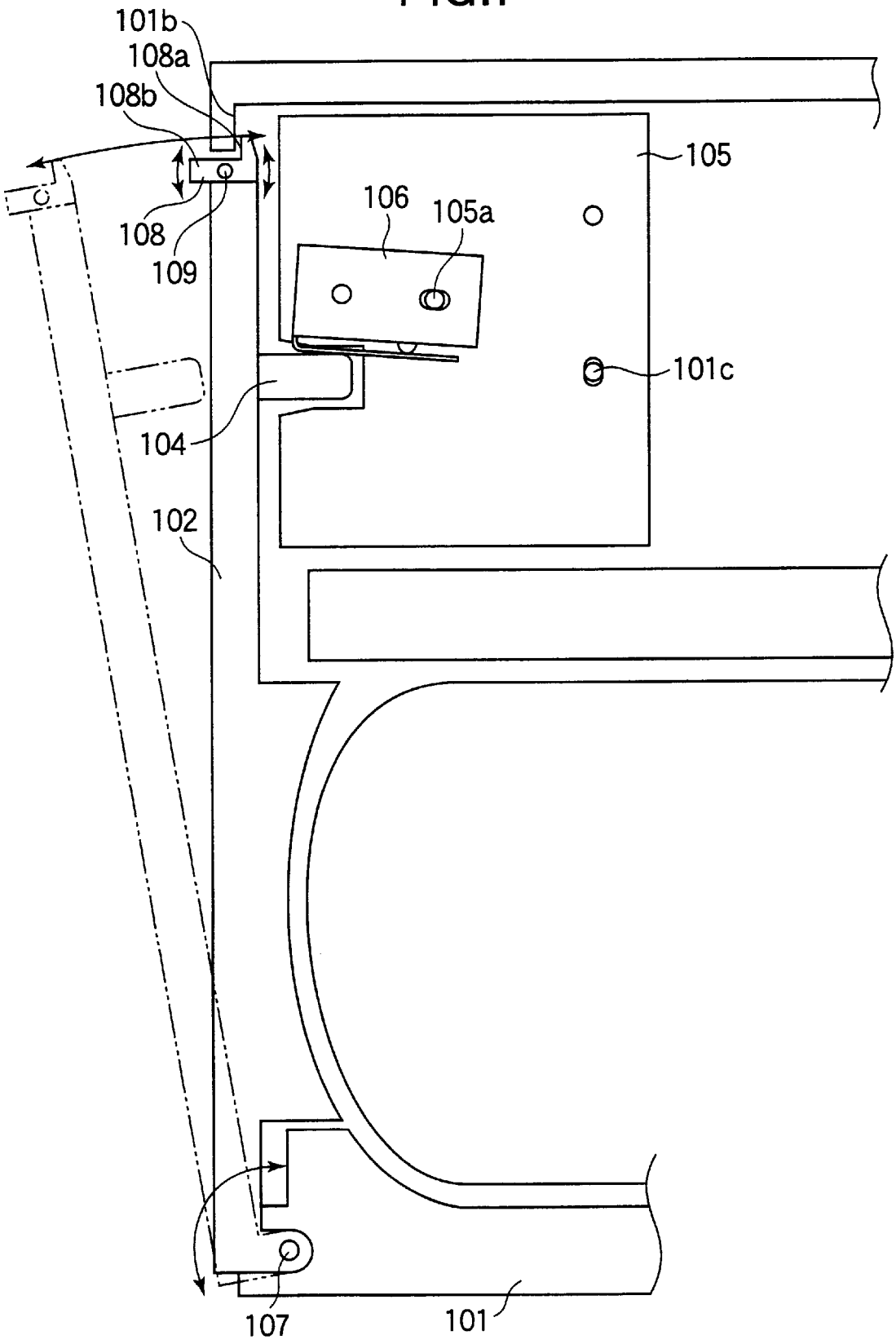
FIG. 7 is a schematic view of the openable and closable cover mechanism of a laser beam printer according to the conventional art.

A description will first be made of an image forming apparatus to which the present invention is applicable. In FIG. 6, a laser beam printer is shown as a typical example of the image forming apparatus of the present invention. The general construction and function of the laser beam printer will hereinafter be described.

In FIG. 6, a feed cassette 20 for stacking and containing sheets S therein is mounted in the lower portion of the main body of the laser beam printer. The feed cassette 20 is detachably attachable to the main body of the laser beam printer. A feed roller 21 feeds the sheets S stacked in the feed cassette 20 one by one from the uppermost sheet. A guide member 22 guides the sheet S fed by the feed roller 21. A conveying roller 23 and a driven roller 24 together constitute a pair of conveying rollers.

A pair of registration rollers 25 ram the leading edge of the sheet S against the nip portion of the pair of registration rollers 25 being stationary to thereby form a loop in the sheet S and correct skew-feeding, thereafter the pair of registration rollers 25 are rotated at predetermined timing and convey the sheet S to image forming means. A process cartridge 26 is detachably mounted in the main body of the apparatus. A photosensitive drum 27 around which an, image forming means, such as a primary charger and a developing device, not shown, and disposed are provided in the process cartridge 26. A laser scanner 28 for scanning a laser beams in conformity with image information effects writing (the formation of a latent image) on the photosensitive drum 27. A transferring roller 29 is in pressure contact with the photosensitive drum 27, and when the sheet S passes between the transferring roller 29 and the photosensitive drum 27, a developed image (toner image) is transferred thereto from the photosensitive drum 27.

A conveying guide 30 guides the sheet S after the transfer of the image thereto to a fixing device. The fixing device fixes the image (toner image) transferred to the sheet S, and is provided with a fixing roller 31, a pressure roller 32, a pair of fixing discharge rollers 33, and so forth. The sheet S is conveyed to a pair of discharge rollers 35 by a pair of conveying rollers 34, and the sheet S after the fixing of the image thereon is discharged out of the apparatus with the image bearing surface thereof facing downward. A discharge tray 36 is formed on the upper surface of the main body of the apparatus, and stacks and holds thereon the sheet S discharge out of the apparatus after the fixing of the image.

A description will now be made of the image forming operation of the laser beam printer constructed as above-described. When the printer is instructed to form an image by a host computer (not shown), the feed roller 21 is first rotated, whereby the sheets S in the feed cassette 20 are fed one by one from the uppermost sheet, and the thus fed sheet is guided to the pair of conveying rollers comprising the conveying roller 23 and the driven roller 24 and to the pair of registration rollers 25 by the guide member 22.

The pair of registration rollers 25 convey the sheet S to between the photosensitive drum 27 and the transferring roller 29 in timed relationship with the image formed on the photosensitive drum 27, and the sheet S has the image (toner image) transferred thereto when the sheet S passes between the photosensitive drum 27 and the transferring roller 29.

Further, the sheet S after the transfer of the image thereto is conveyed to the fixing device along the conveying guide 30, and when the sheet S passes between the fixing roller 31 and the pressure roller 32, heat and pressure are applied to the sheet S and the transferred image is fixed. The sheet S after the fixing of the image thereon is conveyed by the fixing discharge rollers 33 and is further discharged to and stacked on the discharge tray 36 by the pair of discharge rollers 35.

Figure 1:
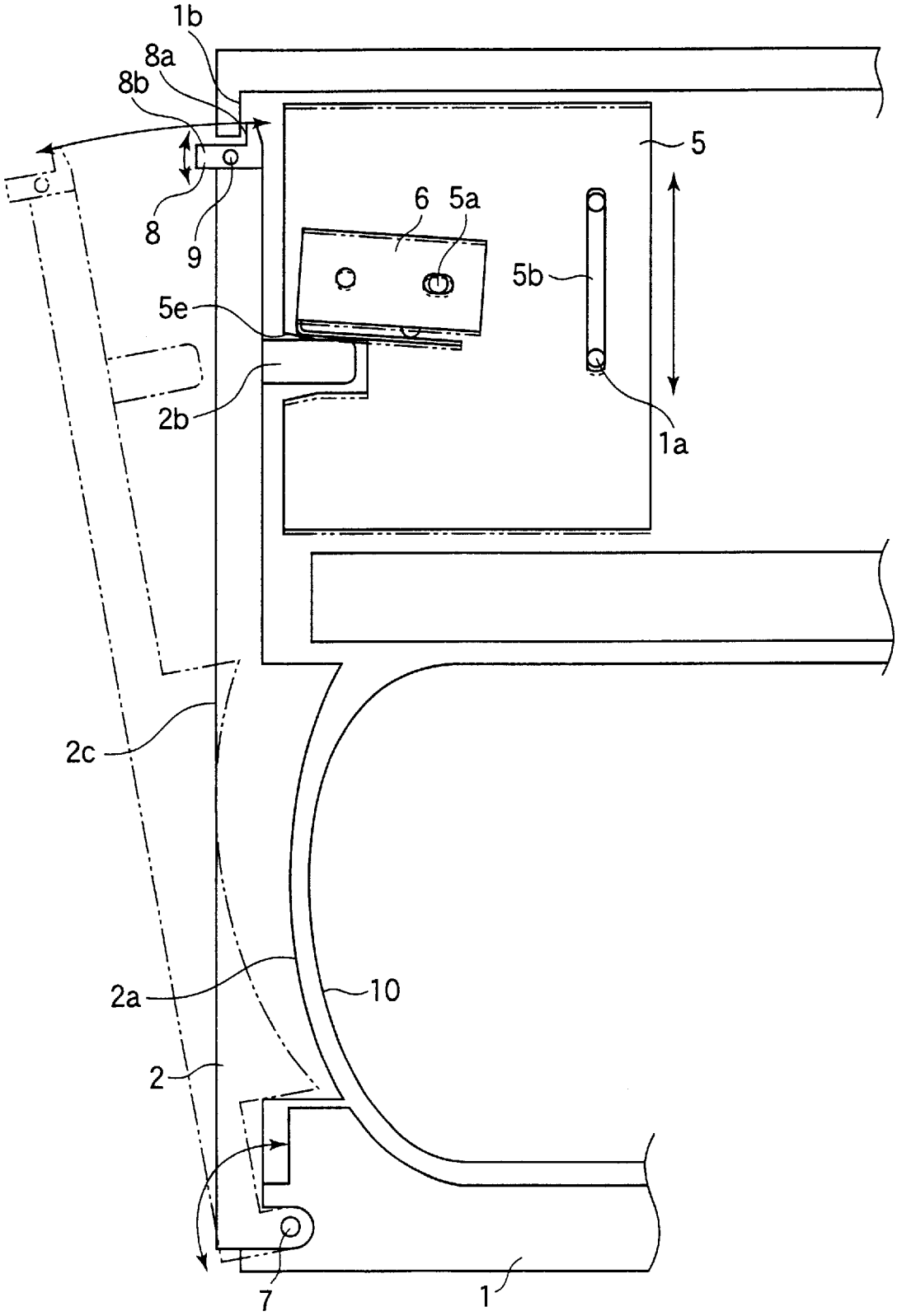
FIG. 1 is a typical cross-sectional view of the openable and closable portion of an image forming apparatus according to an embodiment of the present invention.

The openable and closable cover and the opening and closing detecting mechanism of the present invention will now be described in detail with reference to FIG. 1. FIG. 1 is a typical cross-sectional view of the openable and closable portion of an image forming apparatus according to a first embodiment of the present invention.

In FIG. 1, the openable an closable cover 2 which is an openable and closable member is assembled to the main body 1 of the apparatus for rocking movement with a rocking movement support shaft 7 as a fulcrum. A restraining member 8 for restraining the openable and closable cover 2 on the main body 1 of the apparatus is assembled to the openable and closable cover 2 for rocking movement with a rocking movement support shaft 9 as a fulcrum.

A switch 6 which is a detecting portion for detecting the opening and closing of the openable and closable cover 2 is held by a holder 5 which is a holding member. Detecting means is constituted by the switch 6, which is a detecting portion and the holder 5, which is a holding member.

The holder 5 is provided with a positioning boss 5*a*, which is a position fixing portion for determining the position of the switch 6, and a vertically long slit 5*b* for the holder 5 to become vertically movable.

The switch 6 has its position determined by the positioning boss 5*a* of the holder 5 and is fixed to the holder 5. A restraining portion 1*a* is provided in the main body 1 of the apparatus to vertically movably restrain the holder 5. The restraining portion 1*a* is fitted in the slit 5*b* of the holder 5 and restrains the holder 5 for vertical movement within a predetermined range relative to the main body 1 of the apparatus.

Figure 9:
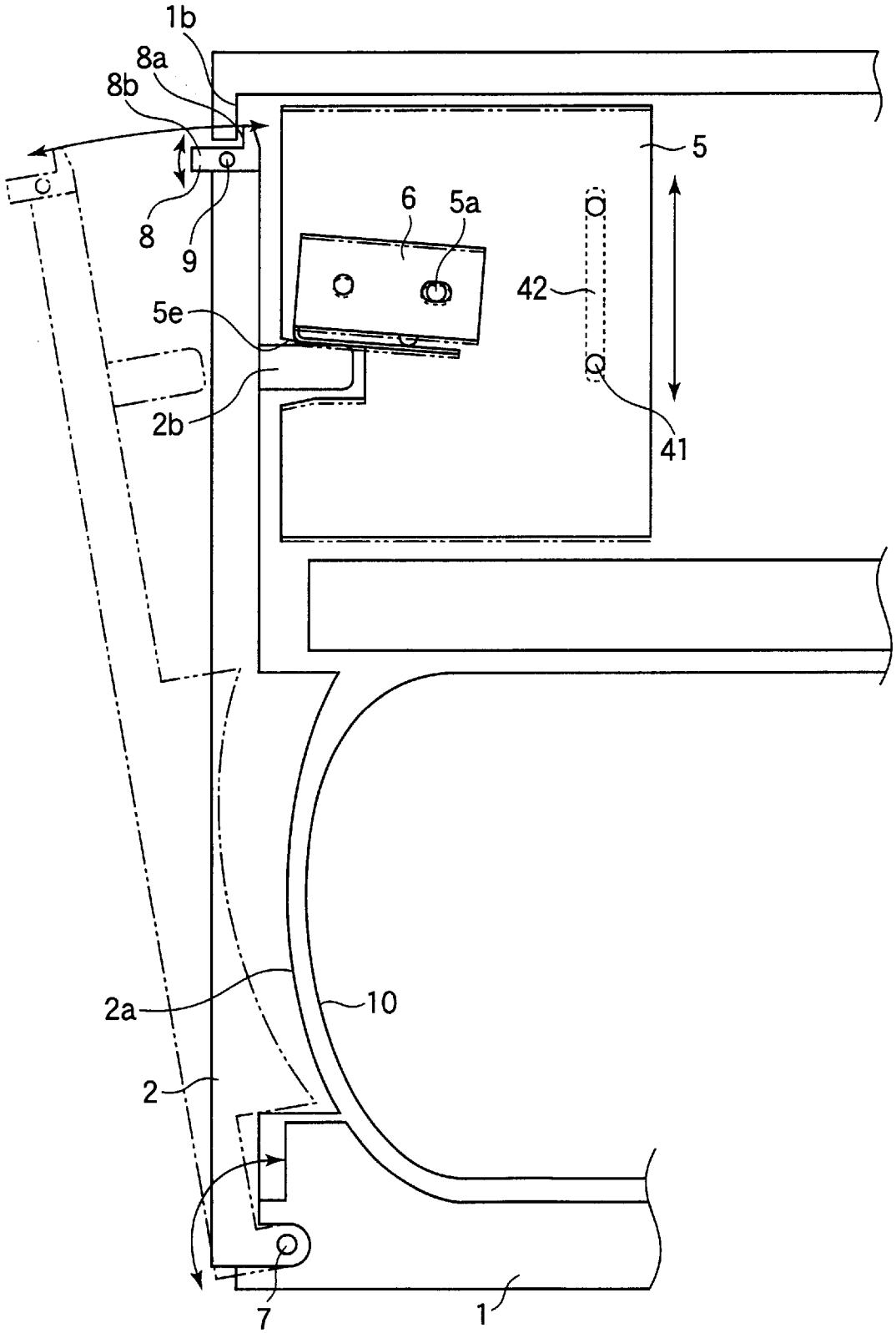
FIG. 9 is a typical cross-sectional view of the openable and closable portion of an image forming apparatus according to a modification of the first embodiment of the present invention.

Also, as the construction for making the holder 5 vertically movable within the predetermined range relative to the main body 1 of the apparatus as shown in FIG. 9, a projection 41 which is a restraining portion for vertically movably restraining the holder 5 may be provided on the holder 5, and a vertically long slit 42 may be provided in the main body 1 of the apparatus so that the projection 41 of the holder 5 may be fitted in the slit 42 of the main body 1 of the apparatus to thereby restrain the holder 5 for vertical movement with a predetermined range relative to the main body 1 of the apparatus.

The openable and closable cover 2 has a conveying guide portion 2*a* constituting a part of a conveying route, and an engagement convex portion 2*b* engaged with the holder 5. The engagement convex portion 2*b* of the openable and closable cover 2 serves also as a positioning portion for determining the position of the holder 5 and a pressure portion for pressing the switch 6. A conveying guide 10 constitutes a part of the conveying route.

When the openable and closable cover 2 is turned to its closed state with the rocking movement support shaft 7 as a fulcrum, the engagement convex portion 2*b* is guided to the switch 6 along a guide portion 5*e*, which is an engagement recess provided in the holder 5. As the engagement convex portion 2*b* is guided along the guide portion 5*e*, the holder 5 is also vertically moved and guided to a predetermined position.

When the openable and closable cover 2 is restrained in its closed state by the restraining member 8 and a lock portion 1*b* provided in the main body 1 of the apparatus, the position of the engagement convex portion 2*b* is determined. By the position of the engagement convex portion 2*b* being determined, the position of the holder 5, which has so far moved in conformity with the movement of the engagement convex portion 2*b*, is also determined, and the switch 6 is pressed by the engagement convex portion 2*b* to thereby detect the closed state of the openable and closable cover 2. By the openable and closable cover 2 being restrained in its closed state, the conveying guide portion 2*a* and the conveying guide 10 together form a part of the conveying route for the sheet.

Also, when the restraint of the openable and closable cover 2 is released and the openable and closable cover 2 is turned to its opened state, the engagement convex portion 2*b* is disengaged from the holder 5, which thus returns to its initial position, and the switch 6 which has so far been pressed is released from the pressure and thus detects the opened state of the openable and closable cover 2.

By such a construction, when the openable and closable cover 2 is closed, the switch 6 is positioned at a predetermined position relative to the engagement convex portion 2*b*, which presses the switch 6, and therefore, it becomes possible to accurately effect the detection of the opened and closed states of the openable and closable cover 2, i.e., the ON and OFF of the switch 6. That is, even if the relative positional deviation due to the tolerance of part occurs between the engagement convex portion 2*b* of the openable and closable cover 2 and the switch 6 for detecting the opened and closed states, the engagement convex portion 2*b* can reliably press the switch 6 and therefore, an erroneous detection of the openable and closable cover 2 can be prevented. Particularly, in a construction wherein the openable and closable cover 2 serves also as a part of the conveying route, the occurrence of jam due to the malfunctioning of the printer when the opened and closed states are erroneously detected wrong.

Second Embodiment

A description will now be made of a second embodiment of the image forming apparatus according to the present invention. In the second embodiment, the same constituent portions as those in the first embodiment are given the same reference characters and need not be described.

Figure 2:
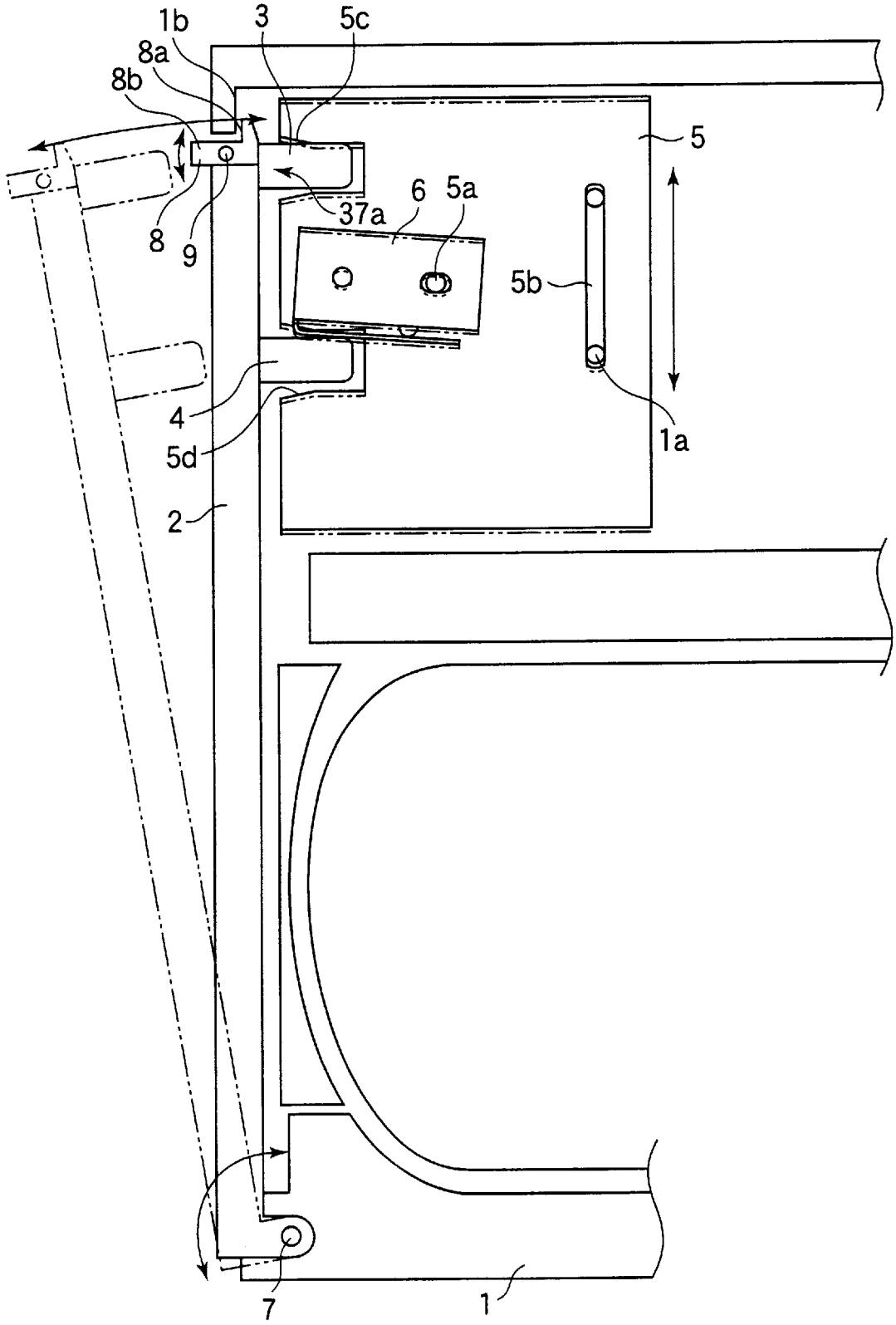
FIG. 2 is a typical cross-sectional view of the openable and closable portion of an image forming apparatus according to a second embodiment of the present invention.

FIG. 2 is a typical cross-sectional view of the openable and closable portion of the second embodiment of the image forming apparatus according to the present invention. The difference of the present embodiment from the first embodiment is that there are plurality of engagement portions by which the openable and closable cover 2 is engaged with the holder 5. Integrally formed with openable and closable cover 2 a first engagement convex portion by a positioning portion 3 for determining the position of the holder 5 and a second engagement convex portion by a pressure portion 4 for pressing the switch 6 to thereby make it detect the opened and closed states of the openable and closable cover 2.

Also, the holder 5 is provided with a guide portion 5*c*, which is a first engagement recess formed into the shape of a laterally long groove for guiding the positioning portion 3, and a guide portion 5*d*, which is a second engagement recess formed into the shape of a laterally long groove for guiding the pressure portion 4.

As the openable and closable cover 2 is turned about the rocking movement support shaft 7 from its opened state to its closed state, the positioning portion 3 is guided to the guide portion 5*c*, and is guided inwardly along a slope formed on the entrance portion of the guide portion 5*c*. With the insertion movement of the positioning portion 3, the holder 5 moves vertically and is guided to a predetermined position. At the same time, the pressure portion 4 is also guided from the guide portion 5*d* to the switch 6.

Figure 8:
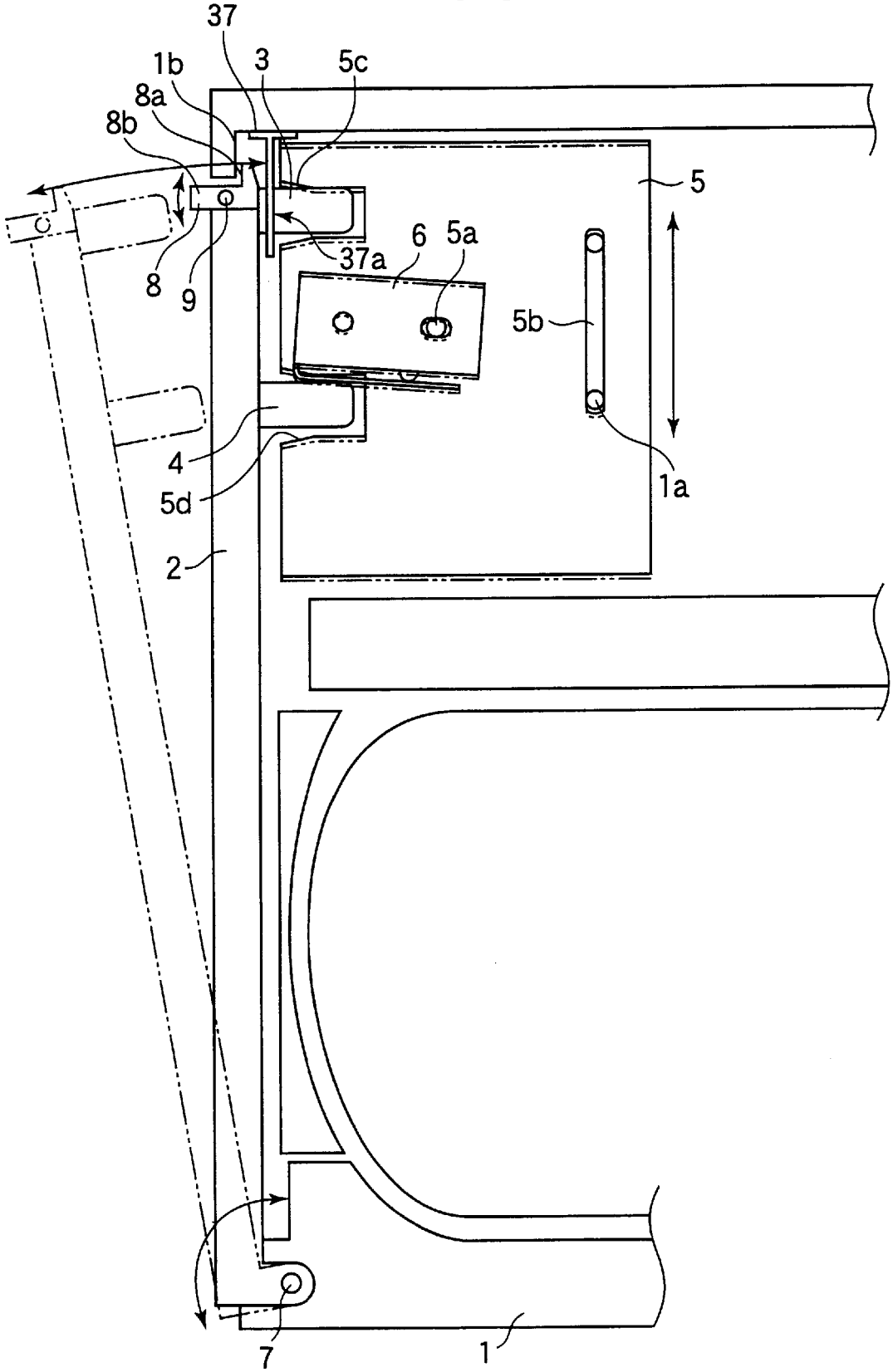
FIG. 8 is a typical cross-sectional view of the openable and closable portion of an image forming apparatus according to a modification of the second embodiment of the present invention.

FIG. 8 is a typical cross-sectional view of the openable and closable portion of an image forming apparatus according to a modification of the second embodiment of the present invention. Only the differences of the modification from the second embodiment shown in FIG. 2 will hereinafter be described.

A metal plate frame 37 fixed to the main body 1 of the apparatus has an engagement hole 37*a* engaged with the positioning portion 3 of the openable and closable cover 2.

As the openable and closable cover 2 is turned about the rocking movement support shaft 7 from its opened state to its closed state, the positioning portion 3 is first guided to the engagement hole 37*a* of the frame 37 and the positioning of the openable and closable cover 2 relative to the main body 1 of the apparatus is effected, and then the positioning portion 3 is guided to the guide portion 5*c* of the holder 5.

In the present embodiment, there are provided a plurality of engagement portions for the openable and closable cover 2 and the holder 5 and therefore, as compared with the case where a single engagement portion is provided, smoother guide can be effected by the engagement portions and an erroneous detection of the openable and closable cover can be reliably prevented. Also, before the openable and closable cover is engaged with the holder, the openable and closable cover is positioned on the frame fixed to the main body of the apparatus, whereby the positional accuracy of the openable and closable cover itself can be enhanced and the more reliable prevention of wrong detection can be accomplished.

Third Embodiment

A description will now be made of a third embodiment of the image forming apparatus according to the present invention. In the third embodiment, the same constituent portions as those in the first embodiment and the second embodiment are given the same reference characters and need not be described.

Figure 3:
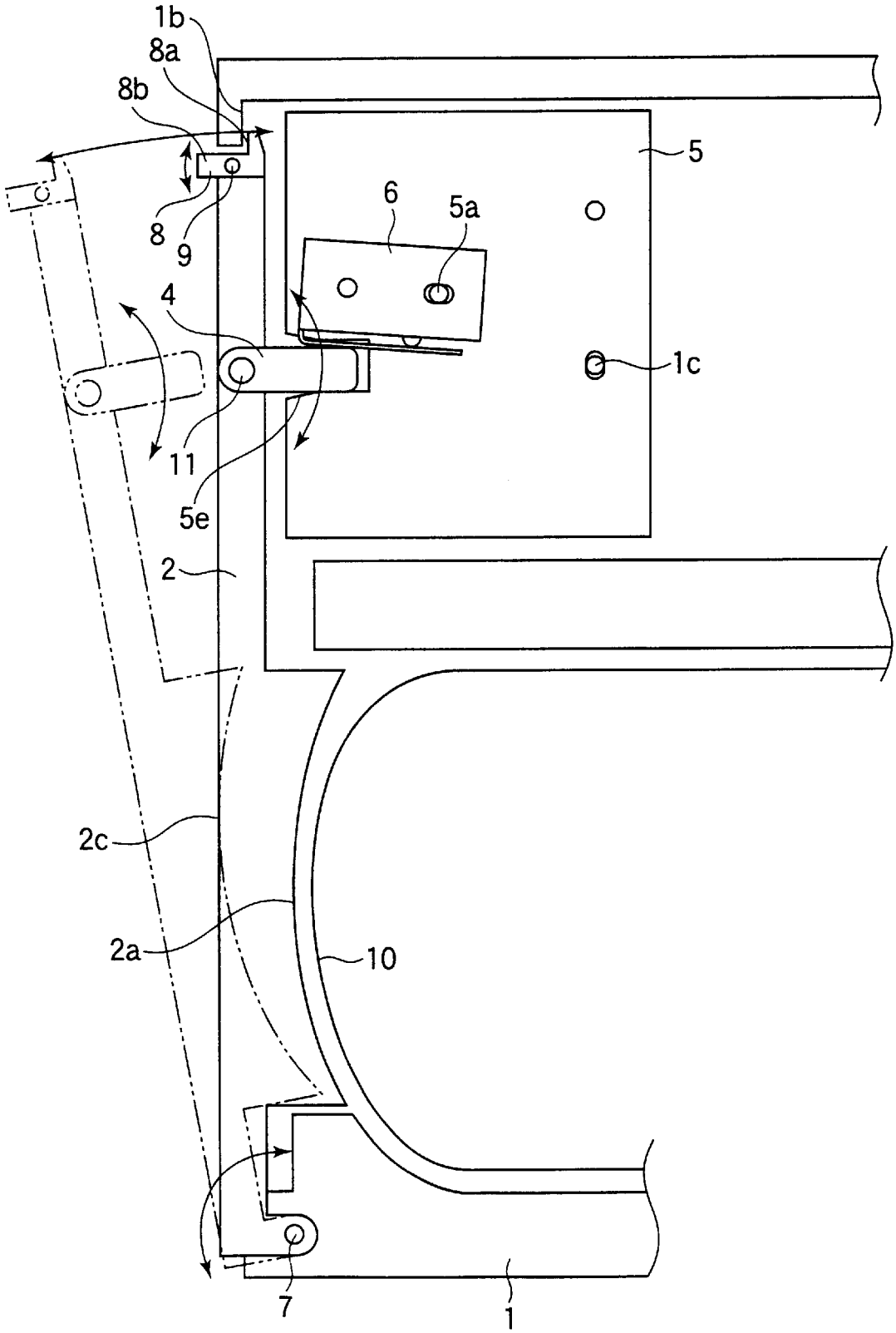
FIG. 3 is a typical cross-sectional view of the openable and closable portion of an image forming apparatus according to a third embodiment of the present invention.

FIG. 3 is a typical cross-sectional view of the openable and closable portion of the third embodiment of the image forming apparatus according to the present invention.

A pressure member 4 pressed the switch 6. The pressure member 4 is assembled to the openable and closable cover 2 for rocking movement with a rocking movement support shaft 11 as a fulcrum. A positioning boss 1*c* provided in the main body 1 of the apparatus fits in a positioning hole, whereby the holder 5 is fixed to the main body 1 of the apparatus. The holder 5 is provided with a guide portion 5*e* formed into the shape of a laterally long groove for guiding the pressure member 4 to the switch 6.

When the openable and closable cover 2 is turned to its closed state, the pressure member 4 is guided to the switch 6 along a slope formed on the entrance side of the guide portion 5*e*. In conformity with the positional relation between the openable and closable cover 2 and the switch 6 when the openable and closable cover 2 is restrained in its closed state by a restraining member 8 and a lock 1*b*, the pressure member 4 pivotally moves along the guide portion 5*e* with the rocking movement support shaft 11 as the fulcrum and is guided to and presses the switch 6.

Also, when the restraint of the openable and closable cover 2 is released and the openable and closable cover 2 is turned to its opened state, the pressure member 4 separates from the switch 6 and has its pressure released to thereby detect the opened state of the openable and closable cover 2.

In the present embodiment, the switch pressure member is rockably assembled to the openable and closable cover, whereby even if the positional accuracy of the openable and closable cover and the switch deviates, the pressure member presses the switch correspondingly to the deviation and the detection of the opened and closed states of the openable and closable cover becomes possible and therefore, even if no special construction is provided on the side of the detecting means fixed to the main body of the apparatus, there can be realized an image forming apparatus in which the opened and closed state of the openable and closable member can be simply detected.

Fourth Embodiment

A description will now be made of a fourth embodiment of the image forming apparatus according to the present invention. In the fourth embodiment, the same constituent portions as those in the first embodiment, the second embodiment and the third embodiment are given the same reference characters and need not be described.

Figure 4:
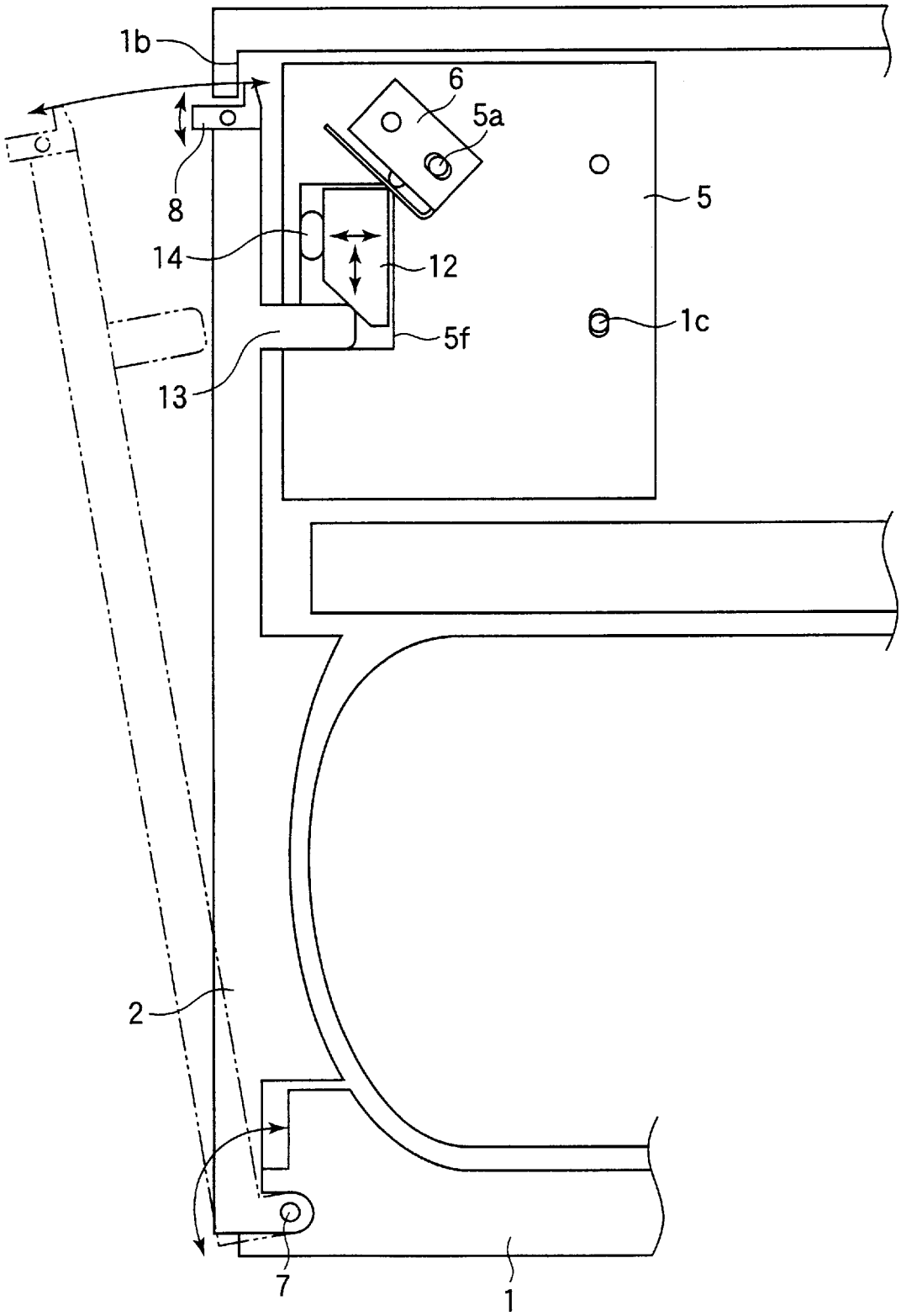
FIG. 4 is a typical cross-sectional view (front view) of the openable and closable portion of an image forming apparatus according to a fourth embodiment of the present invention.
Figure 5:
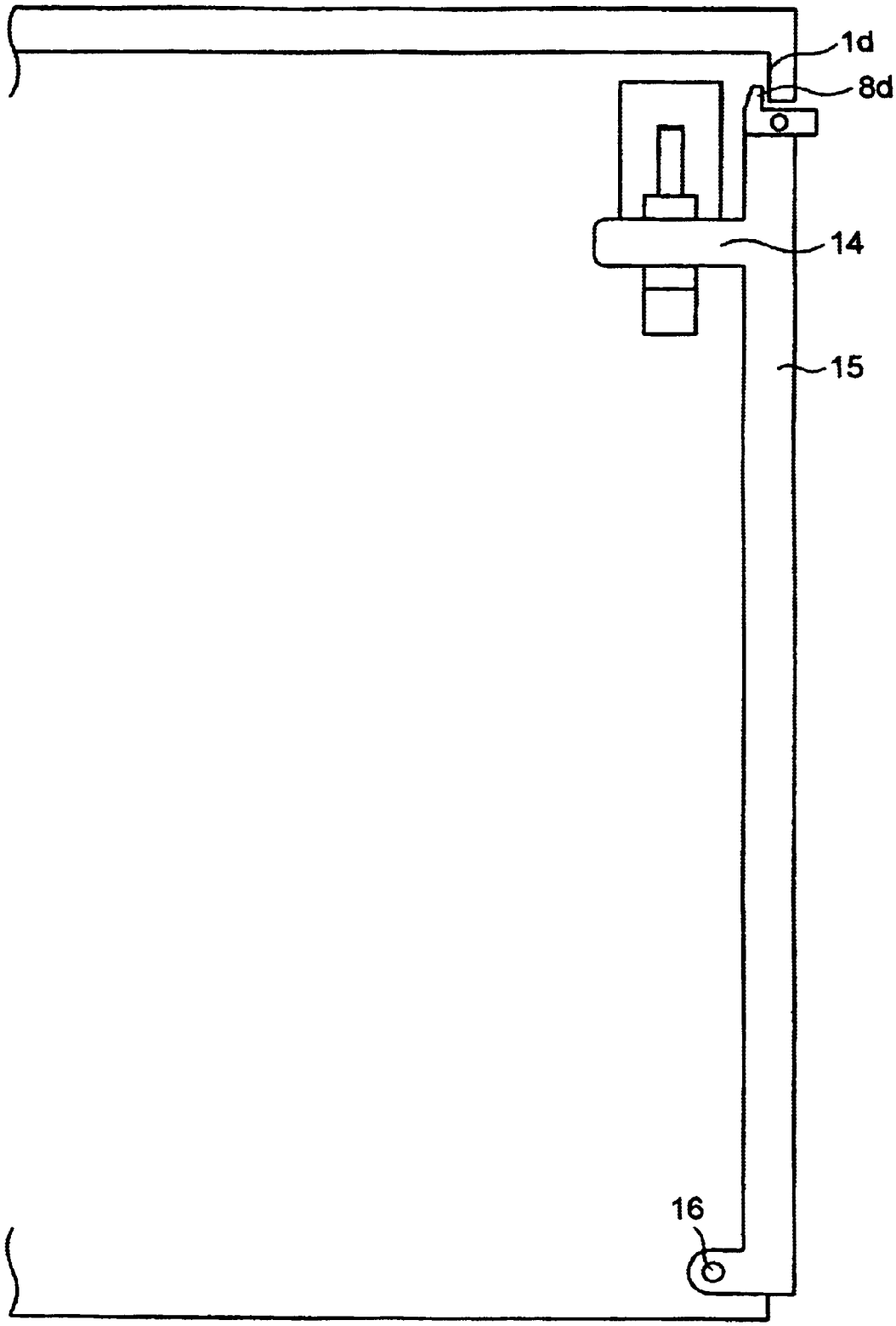
FIG. 5 is a side view of the openable and closable portion of the image forming apparatus according to the fourth embodiment of the present invention.

FIG. 4 is a typical cross-sectional view (front view) of the openable and closable portion of the fourth embodiment of the image forming apparatus according to the present invention, and FIG. 5 is a side view showing a part of the openable and closable portion of the fourth embodiment of the FIG. 4.

In FIGS. 4 and 5, a pressure member 12 presses the switch 6. The pressure member 12 is assembled for vertical and horizontal movement in a space 5*f* provided in the holder 5. A positioning member 13 determines the vertical position of the pressure member 12. The positioning member 13 is assembled to the openable and closable cover 2 provided on the left side of the main body of the image forming apparatus.

A positioning member 14 determines the horizontal position of the pressure member 12. The positioning member 14, as shown in FIG. 5, is assembled to an openable and closable cover 15 provided on this side of the main body of the image forming apparatus.

The switch 6 is fixed by a positioning boss 5*a* provided on the holder 5, which in turn is fixed by a positioning boss 1*c* provided in the main body of the image forming apparatus.

As the left openable and closable cover 2 is closed, the pressure member 12 is upwardly guided due to a wedge effect by the positioning member 13, and when the openable and closable cover 2 is restrained by a restraining member 8 and a lock portion 1*b*, the position of the positioning member 13 is determined, and with the insertion of the positioning member 13, the vertical position of the upwardly guided pressure member 12 is also determined.

On the other hand, as the openable and closable cover 15 on the other side is closed with a rocking movement support shaft 16 as a fulcrum, the horizontal position of the pressure member 12 is guided by the positioning member 14, and when the openable and closable cover 15 on this side is restrained by a pawl-shaped restraining portion 8*d* and a lock portion 1*d*, the position of the positioning member 14 is determined, and with the positioning member 14, the horizontal position of the horizontally guided pressure member 12 is also determined.

When both of the openable and closable cover 2 and the openable and closable cover 15 are restrained in their closed states at a same time, the pressure member 12 presses the switch 6, which thus detects the closed states of the openable and closable cover 2 and the openable and closable cover 15.

Also, when the closed state of one of the openable and closable cover 2 and the openable and closable cover 15 is released, the pressure member 12 moves vertically or horizontally from gravity to thereby release its pressure against the switch 6, which thus detects either the opened state of the openable and closable cover 2 or the openable and closable cover 15 on this side.

With such a construction, the opened and closed states of the two openable and closable members present on the adjacent two sides of the main body of the apparatus can be detected by a single switch.

What is claimed is:

1. An image forming apparatus comprising:

an openable-and-closable member openable and closable relative to a main body of the apparatus;

a switch for detecting opened and closed states of said open-and-closable member; and a holding member for holding said switch, wherein said holding member is movable relative to the main body of the apparatus, wherein said openable-and-closable member has an engagement portion to be engaged with said switch, and said engagement portion positions said holding member.

2. An image forming apparatus according to claim 1, wherein said engagement portion of said openable-and-closable member is a convex portion.

3. An image forming apparatus according to claim 2, wherein said holding member has a recess into which said convex portion fits.

4. An image forming apparatus according to claim 3, wherein said switch is pressed by said convex portion.

5. An image forming apparatus according to claim 1, wherein said holding member is movable in a direction substantially perpendicular to an opening and closing direction of said openable-and-closable member.

6. An image forming apparatus according to claim 5, wherein said holding member has a projection engaged with a slot formed in the main body of the apparatus, and a between said projection and the slot allows said holding member to be movable.

7. An image forming apparatus according to claim 1, wherein said openable-and closable member has a second engagement portion engageable with said holding member without engaging with said switch.

8. An image forming apparatus according to claim 7, wherein at least one engagement portion of said first engagement portion and said second is engaged with a frame fixed to the main body of the apparatus.

* * * * *

UNITED STATES PATENT AND TRADEMARK OFFICE

CERTIFICATE OF CORRECTION

PATENT NO. : 6,678,481 B1
DATED : January 13, 2004
INVENTOR(S) : Kei Sawanaka et al.

It is certified that error appears in the above-identified patent and that said Letters Patent is hereby corrected as shown below:

Column 5,
Line 59, “wrong” should be deleted.

Column 8,
Line 32, “open-and-closable” should read -- openable-and-closable --.
Line 54, “and a” should read -- and a lash --.
Line 58, “openable-and closable” should read -- openable-and-closable --.
Line 63, “said second” should read -- said second engagement portion --.

Signed and Sealed this

Tenth Day of August, 2004

JON W. DUDAS
*Acting Director of the United States Patent and Trademark Office*